US011490710B2

(12) United States Patent
Lee

(10) Patent No.: US 11,490,710 B2
(45) Date of Patent: Nov. 8, 2022

(54) LIPSTICK CONTAINER

(71) Applicant: Jong-bum Lee, Bucheon-si (KR)

(72) Inventor: Jong-bum Lee, Bucheon-si (KR)

( * ) Notice: Subject to any disclaimer, the term of this patent is extended or adjusted under 35 U.S.C. 154(b) by 415 days.

(21) Appl. No.: 16/627,495

(22) PCT Filed: Jul. 3, 2018

(86) PCT No.: PCT/KR2018/007500
§ 371 (c)(1),
(2) Date: Dec. 30, 2019

(87) PCT Pub. No.: WO2019/009580
PCT Pub. Date: Jan. 10, 2019

(65) Prior Publication Data

US 2020/0154852 A1 May 21, 2020

(30) Foreign Application Priority Data

Jul. 3, 2017 (KR) ..... 10-2017-0084116

(51) Int. Cl.
*A45D 40/02* (2006.01)
*A45D 40/06* (2006.01)
(Continued)

(52) U.S. Cl.
CPC ..... *A45D 40/02* (2013.01); *A45D 40/06* (2013.01); *A45D 40/10* (2013.01); *A45D 2040/0025* (2013.01); *A45D 2040/105* (2013.01)

(58) Field of Classification Search
CPC ..... A45D 40/02; A45D 40/06; A45D 2040/0025; A45D 2040/10;
(Continued)

(56) References Cited

U.S. PATENT DOCUMENTS 6,371,673 B1 * 4/2002 Gueret ..... A45D 40/205 401/75
6,905,272 B2 * 6/2005 Yamanaka ..... B65D 83/0011 401/86

FOREIGN PATENT DOCUMENTS

JP 08-010044 1/1996
KR 20-1996-0009305 10/1996
(Continued)

OTHER PUBLICATIONS

The International Search Report corresponding to International Application No. PCT/KR2018/007500 dated Oct. 19, 2018.

*Primary Examiner* — David J Walczak
(74) *Attorney, Agent, or Firm* — Kile Park Reed & Houtteman PLLC

(57) ABSTRACT

The lipstick container includes: a case 3 that has a cylindrical shape and includes a protrusion 21 formed to protrude from the inside thereof; a protective tube 5 rotatably mounted on an upper portion of the case 3; inner containers 7*a* and 7*b* that are rotatably disposed on an inner surface of the case 3 and in which the protrusion 21 of the case 3 is coupled to grooves thereof formed in an vertical direction to rotate together when the case 3 rotates and that includes first and second containers 7*a* and 7*b*; a screw shaft 9 disposed at an inner side of the case 3 so as to be movable up and down; raising/lowering parts 11*a* and 11*b* which are screwed between the inner containers 7*a* and 7*b* and the screw shaft 9 to selectively raise or lower the screw shaft 9.

7 Claims, 5 Drawing Sheets

(51) Int. Cl.
*A45D 40/00* (2006.01)
*A45D 40/10* (2006.01)

(58) Field of Classification Search
CPC .. A45D 2040/105; A45D 40/10; A45D 40/04; B65D 83/0005; B65D 83/0011; B65D 83/0022
USPC ..... 401/68, 70, 77, 78, 83, 171–174
See application file for complete search history.

(56) References Cited

FOREIGN PATENT DOCUMENTS

| | | |
|---|---|---|
| KR | 20-0393383 | 8/2005 |
| KR | 10-1625329 | 5/2016 |
| KR | 10-2017-0067561 | 6/2017 |

* cited by examiner

LIPSTICK CONTAINER

CROSS-REFERENCE TO RELATED APPLICATION

This application claims priority to and the benefit of Korean Patent Application No. 10-2017-0084116 filed in the Korean Intellectual Property Office, the entire contents of which are incorporated herein by reference.

BACKGROUND OF THE INVENTION

(a) Field of the Invention

The present invention relates to a lipstick container, and more particularly, to a lipstick container in which, by improving a structure of a lipstick container, a lipstick may be drawn out by rotation of a case thereof when the lipstick is drawn out and it may be simply and easily stored by pushing a push button when the lipstick is stored.

(b) Description of the Related Art

Generally, women often use lipstick for beauty on their lips. Recently, men also use lip gloss, which is a lipstick-type portable cosmetic, to prevent lips from being chapped in the winter.

In the lipstick-type portable cosmetic, a lipstick made of a cylindrical solid body is disposed inside a case thereof, and the lipstick is drawn out to the outside by rotating the case to contact and apply lips.

In contrast, after using the lipstick, when the lipstick is to be stored in the case, the lipstick is stored by rotating the case in a reverse direction.

However, according to such a conventional lipstick structure, when using or not using the lipstick, since the case has to be rotated with both hands to store or draw out the lipstick, there is an inconvenience to use both hands.

Moreover, when using a smartphone or the like while using the lipstick, an operation of applying the lipstick on the lips should be stopped.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a lipstick container in which a lipstick may be easily stored by a button operation when the lipstick is stored such that the lipstick may be easily stored with one hand.

An embodiment of the present invention provides a lipstick container, including:

a case 3 that has a cylindrical shape and includes a protrusion 21 formed to protrude from the inside thereof;

a protective tube 5 rotatably mounted on an upper portion of the case 3;

inner containers 7*a* and 7*b* that are rotatably disposed on an inner surface of the case 3 and in which the protrusion 21 of the case 3 is coupled to grooves thereof formed in a vertical direction to rotate together when the case 3 rotates and that includes first and second containers 7*a* and 7*b;* a screw shaft 9 disposed at an inner side of the case 3 so as to be movable up and down;

raising/lowering parts 11*a* and 11*b* which are mounted between the inner containers 7*a* and 7*b* and the screw shaft 9 to selectively raise or lower the screw shaft 9 when the case 3 and the inner containers 7*a* and 7*b* are rotated;

lateral moving parts 13, 15, and 17 that are mounted laterally to the inner containers 7*a* and 7*b* to couple or separate the raising/lowering parts 11*a* and 11*b* to and from the screw shaft 9;

an elastic member (S) that is disposed to surround the screw shaft 9 and of which upper portion is supported on an upper portion of the inner containers 7*a* and 7*b* and of which lower portion is supported on a lower portion of the screw shaft 9 to elastically press the screw shaft 9 in a downward direction; and a lipstick support tube 8 that is mounted on an upper portion of the screw shaft 9 to raise and lower the lipstick.

Another embodiment of the present invention provides a lipstick container, including:

a case 3 that has a tubular shape and includes a protrusion 21 formed to protrude in the inside thereof;

a protective tube 5 rotatably mounted on an upper portion of the case 3;

inner containers 7*a* and 7*b* that are disposed on an inner surface of the case 3 and in which the protrusion 21 of the case 3 is coupled to grooves thereof formed in a vertical direction to rotate together when the case 3 rotates, and that includes first and second containers 7*a* and 7*b*, wherein an upper plate 30 is formed in an upper edge of the first and second containers 7*a* and 7*b* in an inward direction, and a lower plate 32 is formed below a predetermined distance, so that a space is formed between the upper plate 30 and the lower plate 32;

a screw shaft 9 disposed at an inner side of the case 3 so as to be movable up and down;

a screw bracket 11*a* of which one side is fixedly mounted between the upper plate 30 and the lower plate 32 of the first container 7*a* of the inner containers 7*a* and 7*b* and a thread is formed on the other side thereof to selectively contact a thread of the screw shaft 9 to raise or lower the screw shaft 9 by rotating together when the case 3 and the inner containers 7*a* and 7*b* rotate;

a support bracket 11*b* of which one side is fixedly mounted between the upper plate 30 and the lower plate 32 of the second container of the inner containers 7*a* and 7*b* and of which the other side is provided with a concave groove, and that has a surface without a thread and supports the screw shaft 9;

a pressing piece 15 that is disposed between the upper plate 30 and the lower plate 32 of the second container and separates the screw bracket 11*a* from the screw shaft 9 by pushing the screw bracket 11*a* in a direction of the first container (a direction opposite to the screw shaft) when being pressed in a direction of the screw shaft 9 by the push button 13;

a push button 13 that is mounted to the case 3 and movable in the direction of the screw shaft 9 and presses the pressing piece 15 in the direction of the screw shaft 9;

an elastic piece 17 that is elastically disposed at the other side of the inner containers 7*a* and 7*b* to elastically press the screw bracket 11*a* to the screw shaft 9;

an elastic member (S) that is disposed to surround the screw shaft 9 and of which upper portion is supported on an upper portion of the inner container 7*a* and 7*b* and of which lower portion is supported on a lower portion of the screw shaft 9 to elastically press the screw shaft 9 in a downward direction; and a lipstick support tube 8 that is mounted on an upper portion of the screw shaft 9 to raise and lower the lipstick.

According to the lipstick container according to the embodiment of the present invention described above, a lipstick is drawn out by rotating a case when a lipstick is drawn out, and the lipstick is stored by simply pressing a push button when the lipstick is stored, thus it is possible to easily store the lipstick in the case with one hand.

DETAILED DESCRIPTION OF THE EMBODIMENTS

Hereinafter, a lipstick container according to an embodiment of the present invention will be described in detail with reference to the accompanying drawings.

Figure 1:
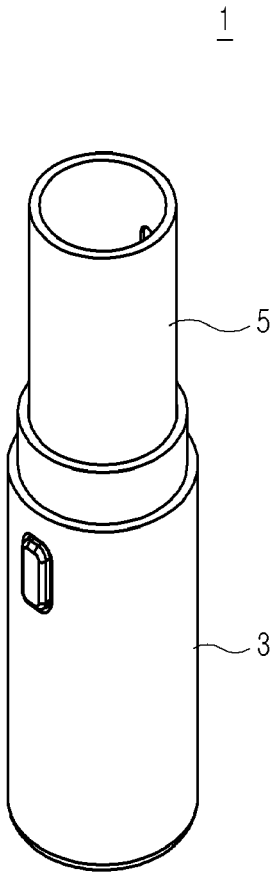
FIG. 1 illustrates a perspective view of an appearance of a lipstick container according to an embodiment of the present invention.
Figure 2:
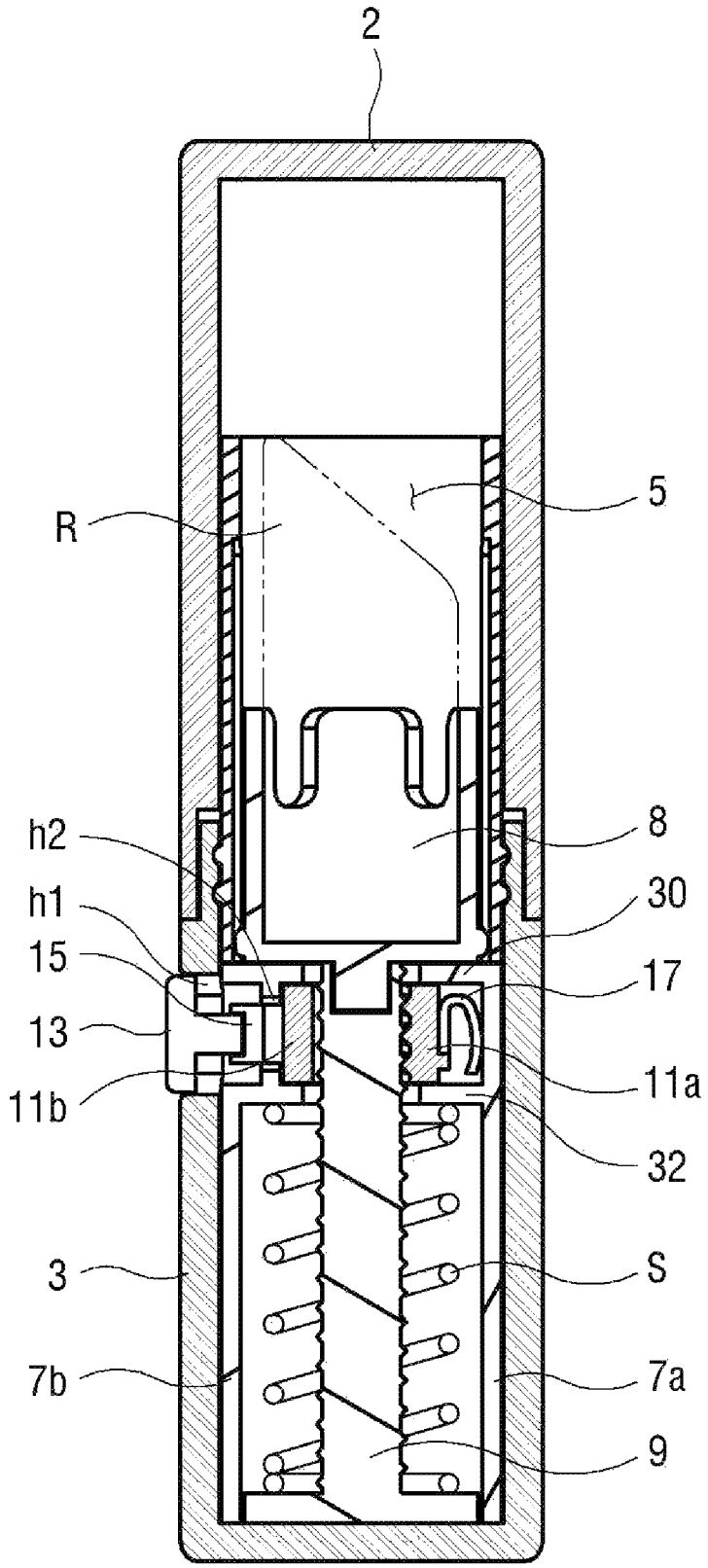
FIG. 2 illustrates a cross-sectional view of an internal structure of the lipstick container illustrated in FIG. 1
Figure 3:
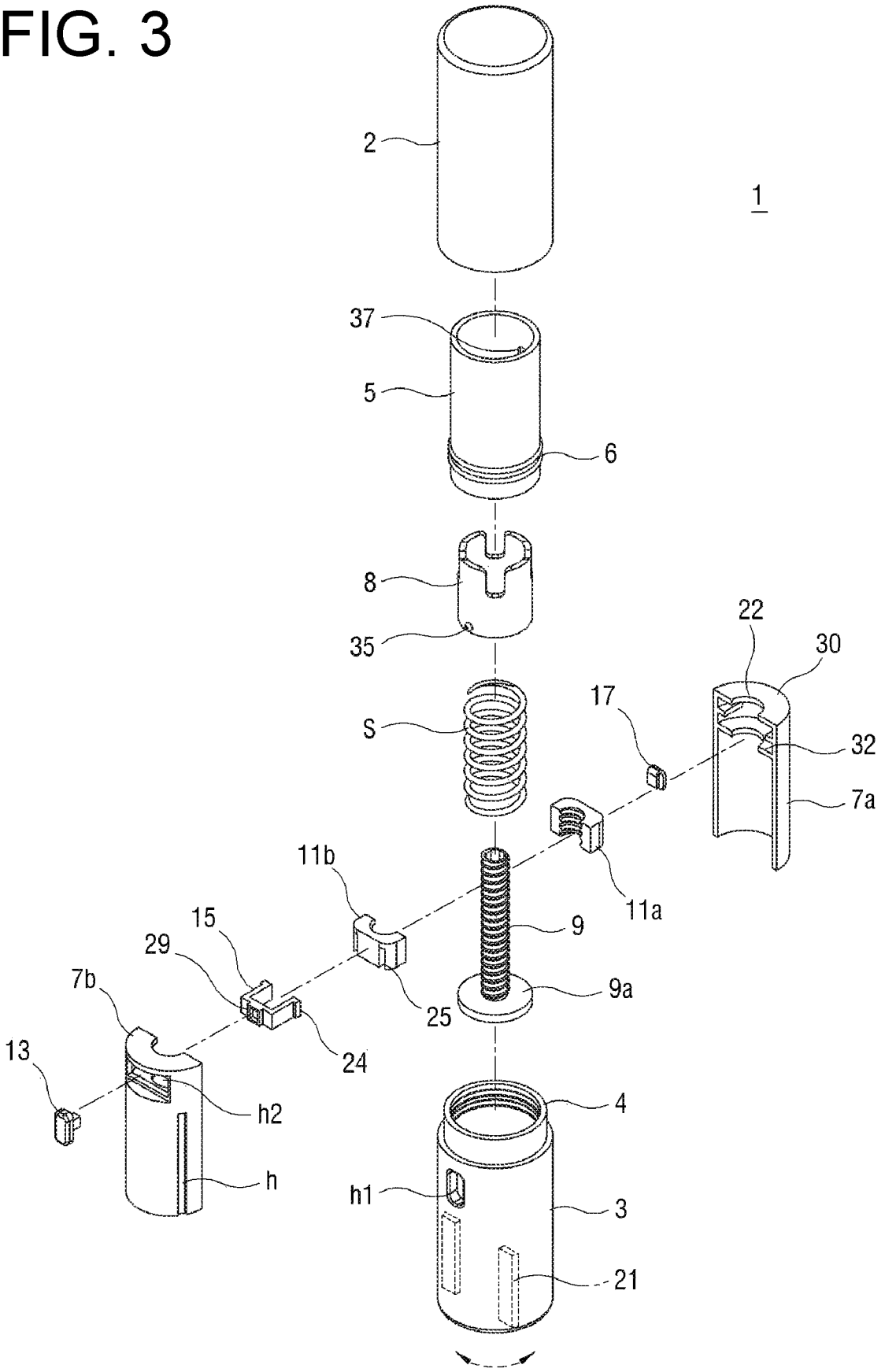
FIG. 3 illustrates an exploded perspective view of the lipstick container illustrated in FIG. 1.
Figure 4A:
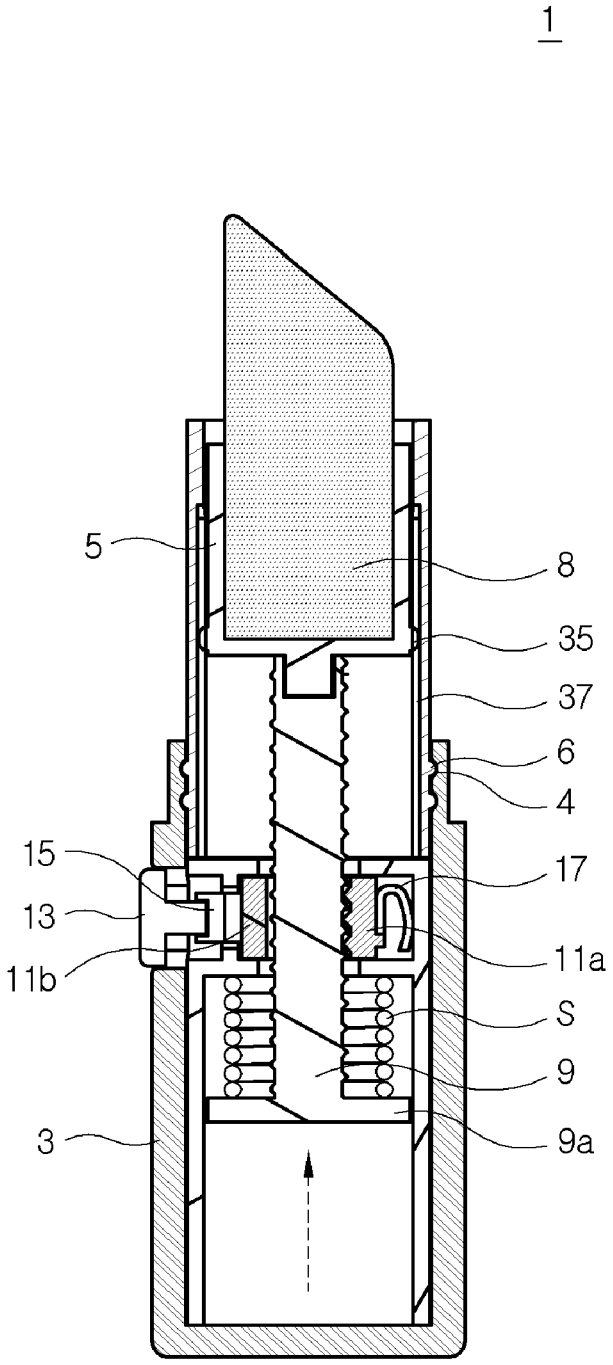
FIG. 4A illustrates a state in which a lipstick is drawn out in using the lipstick container illustrated in FIG. 1.
Figure 4B:
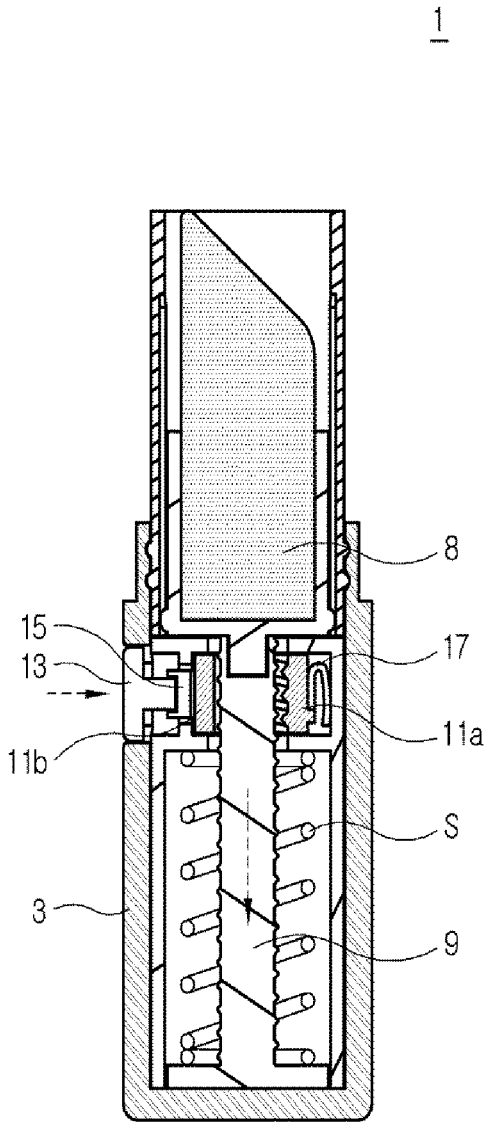
FIG. 4B illustrates a state in which the lipstick is stored.

As shown in FIG. 1 to FIG. 4, a lipstick container 1 proposed by the present invention is used by allowing a user to remove a cap 2 and to rotate a case 3 to raise a lipstick (R) disposed in the inside thereof to protrude outward, and when the lipstick (R) is lowered and stored after using the lipstick (R), the lipstick (R) is easily lowered and stored by elastic force of a spring S by simply pressing a push button 13.

In more detail, the lipstick container 1 includes the case 3; a protective tube 5 rotatably mounted on an upper portion of the case 3; inner containers 7*a* and 7*b* respectively disposed on an inner circumferential surface of the case 3 and rotating together with the case 3; a screw shaft 9 disposed to be moved up and down in an inner side of the case 3; raising/lowering parts 11*a* and 11*b* which are screwed between the inner containers 7*a* and 7*b* and the screw shaft 9 to selectively raise or lower the screw shaft 9 when the case 3 and the inner containers 7*a* and 7*b* are rotated; lateral moving parts 13, 15, and 17 that are mounted laterally to the inner containers 7*a* and 7*b* to couple or separate the raising/lowering parts 11*a* and 11*b* to and from the screw shaft 9; a push button 13 that is mounted on the case 3 to press the lateral moving parts 13, 15, and 17 by moving in a direction of the screw shaft 9; an elastic member (S) that is disposed to surround the screw shaft 9 and of which upper portion is supported on an upper portion of the inner container 7*a* and 7*b* and of which lower portion is supported on a lower portion of the screw shaft 9 to elastically press the screw shaft 9 in a downward direction; and a lipstick support tube 8 that is mounted on an upper portion of the screw shaft 9 to raise and lower the lipstick.

In the lipstick container 1 having such a structure, the case 3 has a cylindrical shape, and a groove 4 is formed in an upper inner circumferential surface thereof, and a guide protrusions 6 that protrudes from a lower outer circumferential surface of the protective tube 5 and is formed along in the circumferential direction, is coupled to the groove 4. Therefore, the protective tube 5 has a structure rotatably coupled to the upper portion of the case 3, and it may hold the protective tube 5 to rotate the case 3 or to hold the case 3 to rotate the protective tube 5.

The case 3 may be formed as one cylinder body, or may be manufactured by combining two semicircular cylinder bodies with each other.

The inner containers 7*a* and 7*b* include a pair of the first container 7*a* and the second container 7*b*. The first and second containers 7*a* and 7*b* have a semicircular cross-sectional shape as a cylindrical shape.

Accordingly, the first and second containers 7*a* and 7*b* are fixedly disposed on the inner circumferential surface of the case 3. In addition, a coupling hole (h) is formed in the first and second containers 7*a* and 7*b*, and a coupling protrusion 21 protruding from the inner circumferential surface of the case 3 is inserted into the coupling hole (h).

Therefore, when the case 3 rotates, the first and second containers 7*a* and 7*b* also rotate together with the case.

In addition, an upper plate 30 is formed on upper edges of the first and second containers 7*a* and 7*b* in an inward direction, and a lower plate 32 is formed below a predetermined distance therefrom. Accordingly, a predetermined space is formed between the upper plate 30 and the lower plate 32, and the raising/lowering parts 11*a* and 11*b* and the lateral moving parts 13, 15 and 17 are disposed in the space.

In addition, holes 22 are formed in center portions of the upper plate 30 and the lower plate 32, and thus, the screw shaft 9 may move up and down through the holes 22.

A screw thread is formed on an outer circumferential surface of the screw shaft 9, and a screw support 9*a* is formed on a lower portion of the screw shaft 9.

Therefore, when the lipstick (R) is not used, the screw shaft 9 is lowered so that the screw support 9*a* is seated on an inner bottom of the case 3, and when the lipstick (R) is used, the screw shaft 9 is raised by the raising/lowering parts 11*a* and 11*b*.

In the above, a pair of the inner containers 7*a* and 7*b* and a pair of the first and second containers 7*a* and 7*b* are described, but the present invention is not limited thereto, and they may be formed as one cylindrical body.

One side of the raising/lowering parts 11*a* and 11*b* are fixedly mounted between the upper plate 30 and the lower plate 32 of the first container 7*a*. Threads are formed on the other side of one of the raising/lowering parts 11*a* and 11*b* to selectively contact threads of the screw shaft 9. Accordingly, the raising/lowering parts 11*a* and 11*b* include a screw bracket 11*a* that raises or lowers the screw shaft 9 by rotating together with the case 3 and the inner containers 7*a* and 7*b* when the case 3 and the inner containers 7*a* and 7*b* rotate; and a support bracket 11*b* that includes one side fixedly mounted between the upper plate 30 and the lower plate 32 of the second container 7*b* and the other side provided with a concave groove, having a surface without a thread, and supporting the screw shaft 9.

When the push button 13 is not pressed, the screw bracket 11*a* is elastically pressed in a direction of the screw shaft 9 by the elastic piece 17 to be described later.

As a result, when the push button 13 is not pressed, both the screw bracket 11*a* and the support bracket 11*b* are in contact with a screw surface of the screw shaft 9, and particularly, the screw bracket 11*a* is screwed with the screw shaft 9.

In this state, when the case 3 is rotated, the first and second containers 7*a* and 7*b* rotate together with the case, and the screw bracket 11*a* and the support bracket 11*b* also rotate about the screw shaft 9. In this case, the screw bracket 11*a* and the support bracket 11*b* are mounted between the upper plate 30 and the lower plate 32 of the first and second containers 7*a* and 7*b*, and the raising of the upper portions of the first and second containers 7*a* and 7*b* are blocked by the lower portion of the protective tube 5.

Accordingly, the screw bracket 11*a* is rotated while the screw bracket 11*a* is screwed with the screw shaft 9 by the rotation of the first and second containers 7*a* and 7*b*, and the screw shaft 9 is relatively raised.

In contrast, when the first and second containers 7*a* and 7*b* rotate in a reverse direction thereof by rotating the case 3 in the reverse direction, the screw bracket 11*a* also rotates in the reverse direction and the screw shaft 9 is lowered.

As a result, in the case of using the lipstick (R), the screw bracket 11*a* is rotated forward by rotating the case 3 in the forward direction to raise the screw shaft 9, thereby raising the lipstick support tube 8 to raise the lipstick (R).

In contrast, when the using of the lipstick (R) is ended, the screw bracket 11*a* is rotated backward by rotating the case 3 in the backward direction to lower the screw shaft 9, thereby lowering the lipstick support tube 8 to lower and store the lipstick (R).

As such, when the screw bracket 11*a* is screwed to the screw shaft 9 to raise or lower the screw shaft 9, the support bracket 11*b* disposed at an opposite side thereof has a shape in which no thread is formed such that the screw shaft 9 may be stably moved up and down without tilting by only supporting one side of the screw shaft 9.

Meanwhile, the lateral moving parts 13, 15, and 17 temporarily separate the screw bracket 11*a* from the screw shaft 9 so that the screw shaft (9) may be lowered by the elastic force of the elastic member (S).

The lateral moving parts 13, 15, and 17 include a pressing piece 15 that is disposed between the upper plate 30 and the lower plate 32 of the second container 7*b* and separates the screw bracket 11*a* from the screw shaft 9 by pushing the screw bracket 11*a* in a direction of the first container (a direction opposite to the screw shaft 9) when being pressed in the direction of the screw shaft 9 by the push button 13; a push button 13 that is mounted to the case 3 and movable in the direction of the screw shaft 9 and presses the pressing piece 15 in the direction of the screw shaft 9; and an elastic piece 17 elastically disposed at the other side of the inner containers 7*a* and 7*b* to elastically press the screw bracket 11*a* to the screw shaft 9.

Specifically, the pressing piece 15 includes a support bar 29 with which the push button 13 is in contact, and a pair of pressing bars 24 that are respectively bent from both ends of the support bar 29 in the direction of the screw shaft 9 and pass through through holes 25 formed in the support bracket 11*b* to contact the screw bracket 11*a*.

Accordingly, when the push button 13 is pressed to be pressed in the direction of the screw shaft 9, the pressing piece 15 is pushed in the direction of the screw shaft 9, and in this case, the pair of pressure bars 24 have penetrated the through hole 25 of the support bracket 11*b*, so that the screw bracket 11*a* is pushed in the direction of the first container 7*a*.

As a result, the screw bracket 11*a*, which is screwed to the screw shaft 9, is pushed in the direction of the first container 7*a* to release a coupling relationship with the screw shaft 9, and the screw shaft 9 is supported by the support bracket 11*b*.

In this case, the elastic member (S) is disposed at the upper portion of the screw support 9*a* of the screw shaft 9, and the upper portion of the elastic member (S) is elastically supported on the bottom surface of the lower plate 32 of the first and second containers 7*a* and 7*b*. The elastic member (S) is a compression spring.

Therefore, when the screw bracket is separated from the screw shaft 9, the screw shaft 9 is pushed downward by the elastic force of the elastic member (S), which is a compression spring, to be lowered.

In addition, the elastic piece 17 presses the screw bracket 11*a* in the direction of the screw shaft 9 so that the screw bracket 11*a* may continuously maintain contact with the screw shaft 9.

The elastic piece 17 may have various structures, for example, may include a leaf spring.

One side of the leaf spring is in contact with the inner circumferential surface between the upper plate 30 and the lower plate 32 of the first container 7*a*, and the other side thereof is in contact with the screw bracket.

Therefore, the leaf spring elastically presses the screw bracket 11*a* in the direction of the screw shaft 9, and conversely, contracts when the pressing piece 15 pushes the screw bracket 11*a* in the direction of the first container 7*a*.

In addition to the leaf spring, any elastic body capable of elastically supporting the screw bracket 11*a* may be included, for example, a compression spring, rubber, and the like may be included.

The push button 13 is mounted by sequentially passing through the first coupling hole (h1) formed in the case 3 and the second coupling hole (h2) formed in the second container 7*b*.

Therefore, when the push button 13 is pushed in the lateral direction (the direction of the screw shaft 9), the push button 13 presses the pressing piece 15, and the pressing piece 15 presses the screw bracket 11*a* in the direction of the first container 7*a* as described above, so that the screw bracket 11*a* is separated from the screw shaft 9.

As a result, when the screw bracket 11*a* is separated, the screw shaft 9 is lowered by the elasticity of the elastic member (S), and the lipstick support tube 8 is also lowered by the lowering of the screw shaft 9, thus the lipstick is also lowered and stored.

The lipstick support tube 8 has a cylindrical shape, and a lipstick is uprightly disposed in the inside thereof, and the lipstick support tube 8 is mounted on an upper portion of the screw shaft 9.

Therefore, when the lipstick support tube 8 is moved up and down by the screw shaft 9, as the lipstick is also moved up and down, a user can use the lipstick.

In this case, a guide protrusion 35 protruding from an outer circumferential surface of the lipstick support tube 8 may be raised and lowered along a guide groove 37 formed in a vertical direction on an inner circumferential surface of the protective tube 5.

That is, when the screw shaft 9 rotates, the lipstick support tube 8 rotates, and the guide protrusion 35 pushes the guide groove 37 of the protective tube 5 in a circumferential direction, and in this case, since the protective tube 5 is rotatably coupled to the upper portion of the case 3, the guide protrusion 35 eventually pushes the guide groove 37 in the circumferential direction, and as the protective tube 5 rotates, it is raised or lowered along the guide groove 37.

Meanwhile, the upper portion of the elastic member (S) is supported on the bottom surfaces of the lower plates 32 of the first and second containers 7*a* and 7*b*, the lower portion thereof is elastically supported on the upper surface of the screw support 9*a* of the screw shaft 9. In addition, the elastic member (S) includes a spring that may press the screw shaft 9 downward, such as a compression spring.

Therefore, when the screw shaft 9 is raised by the rotation of the screw bracket 11*a*, the elastic member (S) may be contracted to preserve the elastic force, and when the screw bracket 11*a* is separated from the screw shaft 9, the elastic member (S) pushes the screw shaft 9 downward so that the screw shaft 9 may be lowered.

In addition to the compression spring, any elastic body capable of elastically pressing the screw shaft 9 downward may be included, for example, a leaf spring, rubber, and the like may be included.

Hereinafter, a process of using the lipstick container according to the embodiment of the present invention will be described in more detail with reference to the accompanying drawings.

As shown in FIG. 1 to FIG. 4, when the lipstick (R) is to be drawn out and used, the protective tube 5 is first grasped and the case 3 is rotated in the forward direction.

As the case 3 rotates, the first and second containers 7*a* and 7*b* mounted in the inside of the case also rotate together, and the screw bracket 11*a* and the support bracket 11*b* also rotate about the screw shaft 9 by the rotation of the first and second containers 7*a* and 7*b*.

In this case, since the screw bracket 11*a* is pressed in the direction of the screw shaft 9 by the elastic piece 17, the screw bracket 11*a* is screwed to the screw shaft 9. In addition, the support bracket simply supports the screw shaft 9 in the opposite direction.

Accordingly, the screw shaft 9 is raised by the rotation of the screw bracket 11*a* and the support bracket, and the lipstick support tube 8 mounted on the upper portion of the screw shaft 9 is also raised.

In addition, when the lipstick support tube 8 is raised, the lipstick (R) is also raised so that the user may use the lipstick (R). In this case, the spring is contracted by the screw support 9*a*.

In contrast, when the lipstick (R) is not used, the lipstick is lowered to be stored, an in this case, two methods such as a button 13 method and a rotation method are possible.

In the case of the button 13 method, the push button 13 protruding from the case 3 is pressed. When the push button 13 is pressed, the push button 13 advances laterally to press the support bar 29 of the pressing piece 15, and the pair of pressure bars 24 pass through the support bracket 11*b* to push the screw bracket 11*a* in the direction of the first container 7*a*.

In this case, the screw bracket 11*a* is supported by the elastic piece 17 and is pushed in the direction of the first container 7*a* by the elastic piece 17 being contracted.

As such, the screw bracket 11*a* is pushed in the direction of the first container 7*a* to be separated from the screw shaft 9, and thus, the screw-coupled state is released.

In this case, the screw shaft 9 is in a state in which the elastic force is acting downward by the spring which is the elastic member (S) as described above.

Therefore, when the screw bracket 11*a* is separated from the screw shaft 9, the screw shaft 9 is lowered by the elastic force of the spring, and the lipstick (R) is also lowered by the screw shaft 9 being lowered.

As such, the lipstick (R) is lowered by the simple operation of pressing the push button 13 to be easily stored.

In addition to the button 13 method, the rotation method is also possible. That is, the rotation method is a method that the lipstick is lowered by rotating the case 3 without pressing the push button 13.

Specifically, when holding the protective tube 5 and rotating the case 3, the first and second containers 7*a* and 7*b* also rotate, and in this case, the screw bracket 11*a* and the support bracket 11*b* are in contact with the screw shaft 9, and the screw bracket 11*a* is in a screw-coupled state.

Accordingly, the screw bracket 11*a* is rotated about the screw shaft 9, and in this case, the screw bracket 11*a* is in a fixed state in a space between the upper plate 30 and the lower plate 32 of the first and second containers 7*a* and 7*b*. Thus, the screw shaft 9 is relatively lowered, and the lipstick (R) may be lowered to be stored, by the lipstick support tube 8 mounted on the upper portion of the screw shaft 9 being lowered as well.

As described above, according to the lipstick container 1 according to the embodiment of the present invention, the push stick 13 may be pressed to lower the lipstick (R), or since the case 3 may be rotated to lower the lipstick (R), thereby improving convenience.

The present invention relates to a lipstick container, and more particularly, to a lipstick container in which, by improving a structure of a lipstick container, a lipstick may be drawn out by rotation of a case thereof when the lipstick is drawn out and it may be simply and easily stored by pushing a push button when the lipstick is stored, and thus it is available to a cosmetic industry field.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A lipstick container comprising:

a case that has a cylindrical shape and includes a protrusion formed to protrude from an inside thereof;

a protective tube rotatably mounted on an upper portion of the case;

inner containers that are rotatably disposed on an inner surface of the case and in which the protrusion of the case is coupled to grooves thereof formed in a vertical direction to rotate together when the case rotates and that includes first and second containers;

a screw shaft disposed at an inner side of the case so as to be movable up and down;

raising/lowering parts which are mounted between the inner containers and the screw shaft to selectively raise or lower the screw shaft when the case and the inner containers are rotated;

lateral moving parts that are mounted laterally to the inner containers to couple or separate the raising/lowering parts to and from the screw shaft;

an elastic member that is disposed to surround the screw shaft and of which upper portion is supported on an upper portion of the inner container and of which lower portion is supported on a lower portion of the screw shaft to elastically press the screw shaft in a downward direction; and a lipstick support tube that is mounted on an upper portion of the screw shaft to raise and lower the lipstick.

2. The lipstick container of claim 1, wherein the inner containers include an upper plate formed at upper edges thereof in an inward direction, and a lower plate formed below the upper plate at a predetermined distance from the upper plate, and the raising/lowering parts and the lateral moving parts are disposed between the upper plate and the lower plate.

3. The lipstick container of claim 2, wherein the raising/lowering parts include a screw bracket of which one side is fixedly mounted between the upper plate and the lower plate of the first container and in which a thread is formed on the other side thereof to selectively contact a thread of the screw shaft to raise or lower the screw shaft by rotating together when the case and the inner containers rotate; and a support bracket of which one side is fixedly mounted between the upper plate and the lower plate of the second container and of which the other side is provided with a concave groove, and that has a surface without a thread and supports the screw shaft.

4. The lipstick container of claim 3, wherein the lateral moving parts include a pressing piece that is disposed at one side of the inner containers and between the upper plate and the lower plate of the second container and separates the screw bracket from the screw shaft by pushing the screw bracket in a direction of the first container, which is a direction opposite to the screw shaft, when being pressed in a direction of the screw shaft by the push button;

a push button that is mounted to the case and movable in the direction of the screw shaft and presses the pressing piece in the direction of the screw shaft;

an elastic piece that is elastically disposed at the other side of the inner containers to elastically press the screw bracket to the screw shaft.

5. The lipstick container of claim 4, wherein the pressing piece includes a support bar with which the push button is in contact, and a pair of pressing bars that are respectively bent from both ends of the support bar in the direction of the screw shaft and pass through through holes formed in the support bracket to contact the screw bracket.

6. A lipstick container comprising:

a case that has a cylindrical shape and includes a protrusion formed to protrude from an inside thereof;

a protective tube rotatably mounted on an upper portion of the case;

inner containers that are disposed on an inner surface of the case and in which the protrusion of the case is coupled to grooves thereof formed in a vertical direction to rotate together when the case rotates, and that includes first and second containers, wherein an upper plate is formed in an upper edge of the first and second containers in an inward direction, and a lower plate is formed below the upper plate at a predetermined distance from the upper plate, so that a space is formed between the upper plate and the lower plate;

a screw shaft disposed at an inner side of the case so as to be movable up and down;

a screw bracket of which one side is fixedly mounted between the upper plate and the lower plate of the first container of the inner containers and a thread is formed on the other side thereof to selectively contact a thread of the screw shaft to raise or lower the screw shaft by rotating together when the case and the inner containers rotate;

a support bracket of which one side is fixedly mounted between the upper plate and the lower plate of the second container of the inner containers and of which the other side is provided with a concave groove, and that has a surface without a thread and supports the screw shaft;

a pressing piece that is disposed at one side of the inner containers and between the upper plate and the lower plate of the second container and separates the screw bracket from the screw shaft by pushing the screw bracket in a direction of the first container, which is a direction opposite to the screw shaft, when being pressed in a direction of the screw shaft by a push button;

wherein the push button is mounted to the case and movable in the direction of the screw shaft and presses the pressing piece in the direction of the screw shaft;

an elastic piece that is elastically disposed at the other side of the inner containers to elastically press the screw bracket to the screw shaft;

an elastic member that is disposed to surround the screw shaft and of which upper portion is supported on an upper portion of the inner container and of which lower portion is supported on a lower portion of the screw shaft to elastically press the screw shaft in a downward direction; and a lipstick support tube that is mounted on an upper portion of the screw shaft to raise and lower the lipstick.

7. The lipstick container of claim 6, wherein the pressing piece includes a support bar with which the push button is in contact, and a pair of pressing bars that are respectively bent from both ends of the support bar in the direction of the screw shaft and pass through through holes formed in the support bracket to contact the screw bracket.

* * * * *